US006639492B1

(12) United States Patent
Hall et al.

(10) Patent No.: US 6,639,492 B1
(45) Date of Patent: Oct. 28, 2003

(54) INDICATOR RESET TOOL, AND CIRCUIT BREAKER AND METHOD EMPLOYING THE SAME

(75) Inventors: Thomas M. Hall, Sarasota, FL (US); Michael F. Walz, Bradenton, FL (US); Peter L. Nerstrom, Sarasota, FL (US); James M. McCormick, Bradenton, FL (US); Paul J. Rollmann, Brown Deer, WI (US); Edward L. Wellner, Colgate, WI (US); Steven C. Schmalz, Greenfield, WI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/342,837

(22) Filed: Jan. 15, 2003

(51) Int. Cl.[7] ..... H01H 73/12; H01H 9/00; H01H 13/52; H01H 71/52

(52) U.S. Cl. ..... 335/6; 200/308; 200/334; 337/66

(58) Field of Search ..... D8/17, 21, 27; 200/61.89, 52 R, 308–345; 335/6–18; 337/66, 188

(56) References Cited

U.S. PATENT DOCUMENTS 3,792,403 A * 2/1974 Bullock ..... 337/66
4,144,422 A * 3/1979 Ramos ..... 20/318 X
4,151,385 A * 4/1979 Neuser et al. ..... 200/331 X
4,686,503 A * 8/1987 Miller ..... 200/61.89 X
5,459,446 A * 10/1995 Vidal et al. ..... 337/188
5,847,913 A * 12/1998 Turner et al. ..... 361/93
6,107,902 A * 8/2000 Zhang et al. ..... 200/308 X
6,242,704 B1 * 6/2001 Ambrose et al. ..... 200/331
6,307,453 B1 * 10/2001 Wellner et al. ..... 335/6
6,542,056 B2 * 4/2003 Nerstrom et al. ..... 200/317 X

OTHER PUBLICATIONS

Copy of U.S. patent application No. 09/845,517.*

* cited by examiner

*Primary Examiner*—J. R. Scott
(74) *Attorney, Agent, or Firm*—Marvin L. Union

(57) ABSTRACT

An indicator reset tool is for a movable arc fault indicator of a circuit breaker. The circuit breaker further includes a housing enclosing separable contacts, an operating mechanism for opening and closing the separable contacts, and an operating handle protruding through an opening in the housing. An actuator actuates the movable indicator arc fault indicator and actuates the operating mechanism to trip the separable contacts open. The indicator reset tool includes a reset member having a first end with an indicator engaging portion structured to depress and reset the movable arc fault indicator. The second end of the reset member includes a handle portion for gripping by a user.

22 Claims, 7 Drawing Sheets

INDICATOR RESET TOOL, AND CIRCUIT BREAKER AND METHOD EMPLOYING THE SAME

BACKGROUND OF THE INVENTION

1. Field of the Invention

The present invention relates generally to electrical switching apparatus and, more particularly, to a tool for resetting a circuit breaker indicator, such as, for example, a movable arc fault indicator. The invention also relates to a circuit breaker including a reset tool for engaging a movable arc fault indicator. The invention further relates to a method for engaging and resetting a movable arc fault indicator.

2. Background Information

Circuit breakers traditionally have provided overcurrent protection through use of, for example, a bimetal coupled to a spring-loaded operating mechanism. Recently, arc fault protection has been added to circuit breakers. Arc faults are typically high impedance faults and can be intermittent. Nevertheless, such arc faults can result in a fire.

The addition of electronic arc fault sensing to a circuit breaker can add one of the elements required for sputtering arc fault protection. Ideally, an electronic circuit detects current signatures associated with arcing, and an arc fault trip signal generated by the electronic circuit energizes a trip coil that triggers the spring-loaded operating mechanism to open the separable contacts of the circuit breaker.

However, it is often desirable in circuit breakers providing both arc fault protection and overcurrent protection to provide an indication of the type of fault that has caused the breaker to trip. An example of a separate arc fault indicator can be seen in commonly assigned U.S. patent application Ser. No. 09/845,517, filed Apr. 30, 2001, now U.S. Pat. No. 6,522,228, which discloses a movable, illuminated ring disposed around the push/pull handle of a subminiature circuit breaker. The ring pops up to indicate an arc fault trip condition.

In certain applications, particularly aircraft electrical systems, certain circuits are so critical that manual intervention by a crewmember may be desirable before a circuit is de-energized, for example, without limitation, certain avionic and navigation instrumentation, electric fuel pumps, and electrical components of the landing gear system. The vital nature of such systems may necessitate in flight manual override or reset of a circuit breaker, which was tripped open by an arc fault, as indicated by an arc fault indicator, in order to safely continue the flight until the aircraft can land and repairs can be made. The arc fault indicator may be reset, either in flight, or, more commonly, following maintenance repairs on the ground.

There is, therefore, a need to quickly, easily, and economically reset the arc fault indicator of a circuit breaker.

SUMMARY OF THE INVENTION

This need and others are satisfied by the invention, which is directed to a tool for resetting circuit breaker indicators and a method employing the same.

As one aspect of the invention, an indicator reset tool is used with an electrical switching apparatus, which includes a housing having an opening, separable contacts mounted within the housing, an operating mechanism for opening and closing the separable contacts, an operating handle protruding from the opening of the housing, a movable indicator, and an actuator for actuating the movable indicator and actuating the operating mechanism to trip the separable contacts open, the indicator reset tool comprises: a reset member including a first end a second end, the first end of the reset member having an indicator engaging portion structured to depress and reset the movable indicator when actuated, the second end of the reset member having a handle portion structured for gripping by a user.

As another aspect of the invention, a circuit breaker comprises: a housing with an opening; an operating handle protruding from the opening; separable contacts mounted within the housing; an operating mechanism for opening and closing the separable contacts; an overcurrent assembly responsive to selected conditions of current flowing through the separable contacts for actuating the operating mechanism to trip the separable contacts open; a movable arc fault indicator; an arc fault trip actuator which when energized actuates the movable arc fault indicator and actuates the operating mechanism to trip the separable contacts open; an arc fault current assembly responsive to selected arc fault conditions of current flowing through the separable contacts for energizing the arc fault trip actuator to actuate the movable arc fault indicator and to activate the operating mechanism to activate the operating mechanism to trip the separable contacts open; and a reset tool comprising: an elongated handle member; and an indicator engagement portion disposed opposite the elongated handle member, the indicator engagement portion structured to engage and reset the movable arc fault indicator.

As another aspect of the invention, a method for resetting an arc fault indicator of a circuit breaker comprises: employing a circuit breaker including a housing with an opening through which an operating handle protrudes; providing a movable arc fault indicator; providing a reset tool with a handle member and an indicator engagement region structured to engage the movable arc fault indicator; holding the handle member of the reset tool; engaging the movable arc fault indicator with the indicator engagement region of the reset tool; and pressing downward on the handle member in order that the indicator engagement region depresses and resets the movable arc fault indicator.

The method may comprise: providing a first circumference on the operating handle; providing a recess in the indicator engagement region of the reset tool, with the recess corresponding to the first circumference of the operating handle; providing a second circumference on the movable arc fault indicator; providing a projection on the indicator engagement region, with the projection corresponding to the second circumference of the movable arc fault indicator; and engaging at least a portion of the movable arc fault indicator with the projection of the indicator engagement portion of the reset tool.

The method may comprise engaging at least a portion of the operating handle with the recess of the indicator engagement portion of the reset tool.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to the movable arc fault indicator of an aircraft circuit breaker, although it will become apparent that it could also be applied to indicators in a wide range of circuit breaker applications (e.g., without limitation, residential, commercial, industrial, aerospace, and automotive circuit breaker applications).

Figure 1A:
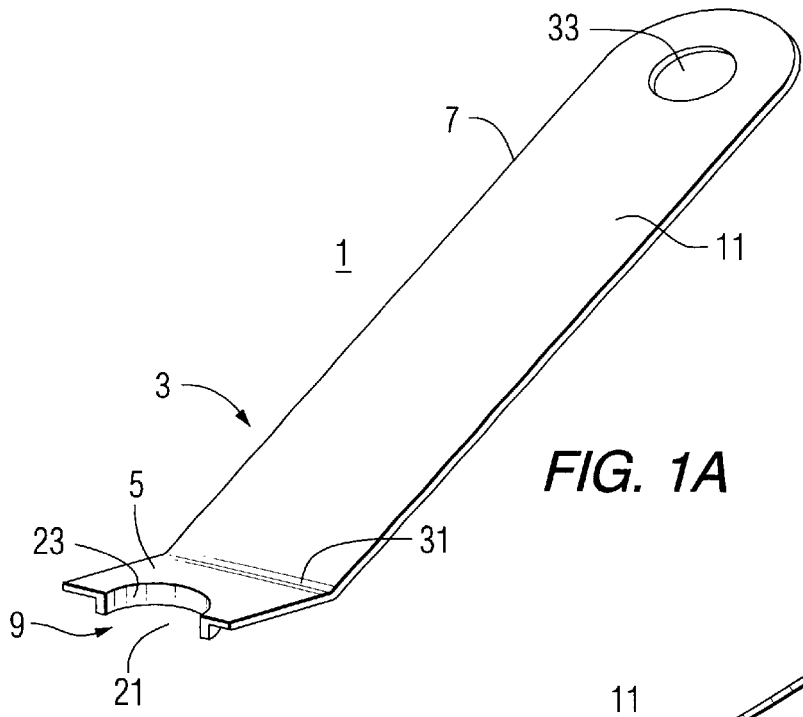
FIG. 1A is an isometric view of an indicator reset tool in accordance with the present invention.
Figure 1B:
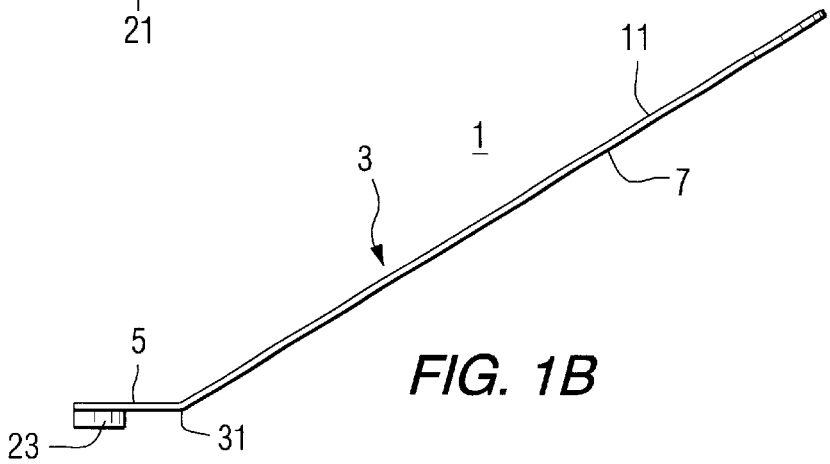
FIGS. 1B and 1C are vertical elevation and plan views, respectively, of the indicator reset tool of FIG. 1A.
Figure 1C:
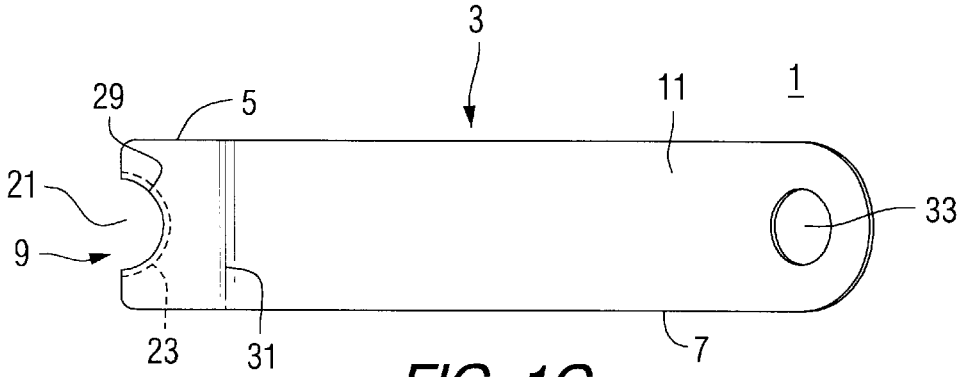

Referring to FIGS. 1A, 1B, and 1C, an indicator reset tool 1 includes a reset member 3 having a first end 5 and a second end 7. The first end 5 has an indicator engaging portion 9. The second end 7 has a handle portion 11. To provide improved user gripping, the exemplary indicator reset tool 1 includes a bend 31 between the first and second ends 5,7 thereof, in order that the indicator engaging portion 9 is offset from the handle portion 11. Alternatively, it will be appreciated that the indicator reset tool 1 may be straight (not shown) or may have a plurality of bends (not shown). The exemplary indicator reset tool 1 also includes an aperture 33 proximate the second end 7 of the reset member 3 (as best shown in FIGS. 1A and 1C). This aperture 33 permits attachment of the indicator reset tool 1 to, for example, a key ring (not shown), or a hook (not shown) proximate a circuit breaker 100 (FIG. 2).

Figure 2:
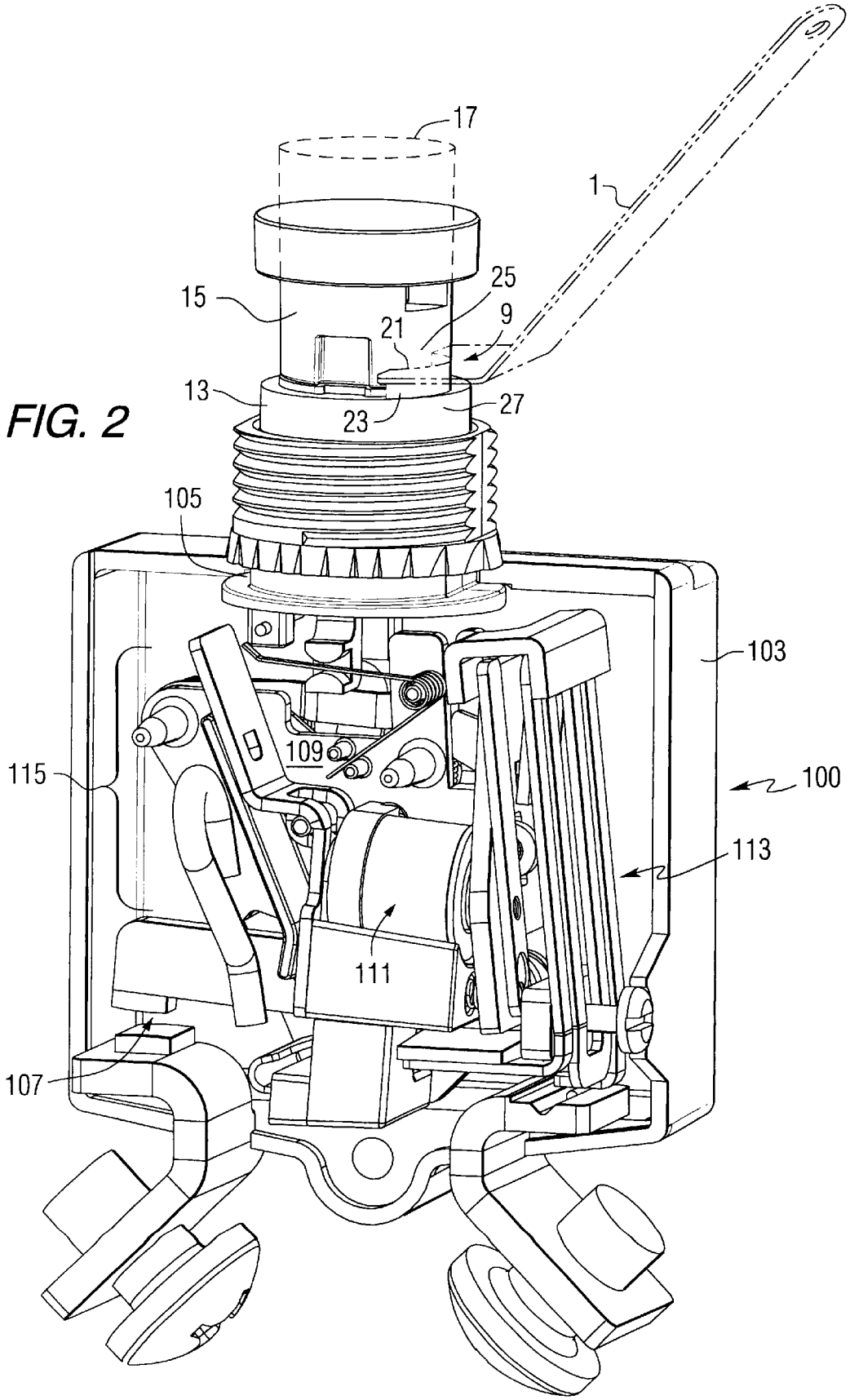
FIG. 2 is an isometric view of an aircraft circuit breaker with a movable arc fault indicator, with the circuit breaker housing partially cut-away to show internal structures, and the indicator reset tool of FIG. 1A, shown in phantom line drawing.

The indicator engaging portion 9 of the indicator reset tool 1 includes a recess, such as an arcuate recess 21 (FIGS. 1A and 1C), and a projection, such as an arcuate projection 23 (as best shown in FIG. 2; and shown in hidden line drawing in FIG. 1C).

FIG. 2 illustrates the basic components of an aircraft circuit breaker 100 including a housing 103 enclosing separable contacts 107 and an operating mechanism 109, which opens and closes the separable contacts 107. The circuit breaker 100 further includes an opening 105 in the housing 103, an operating handle 15, which protrudes from the opening 105, and a movable arc fault indicator 13. Internal circuit breaker components, shown in FIG. 2, include an arc fault trip actuator 111 for actuating the movable arc fault indicator 13 and actuating the operating mechanism 109 to trip the separable contacts 107 open in response to an arc fault.

The exemplary circuit breaker 100 also includes an overcurrent assembly 113 that is responsive to selected conditions of current flowing through the separable contacts 107 for actuating the operating mechanism 109 to trip the separable contacts 107 open; the arc fault trip actuator 111, which when energized, actuates the movable arc fault indicator 13; and an arc fault current assembly 115, which responds to selected arc fault conditions of current flowing through the separable contacts 107 to energize the arc fault trip actuator 111.

Figure 3:
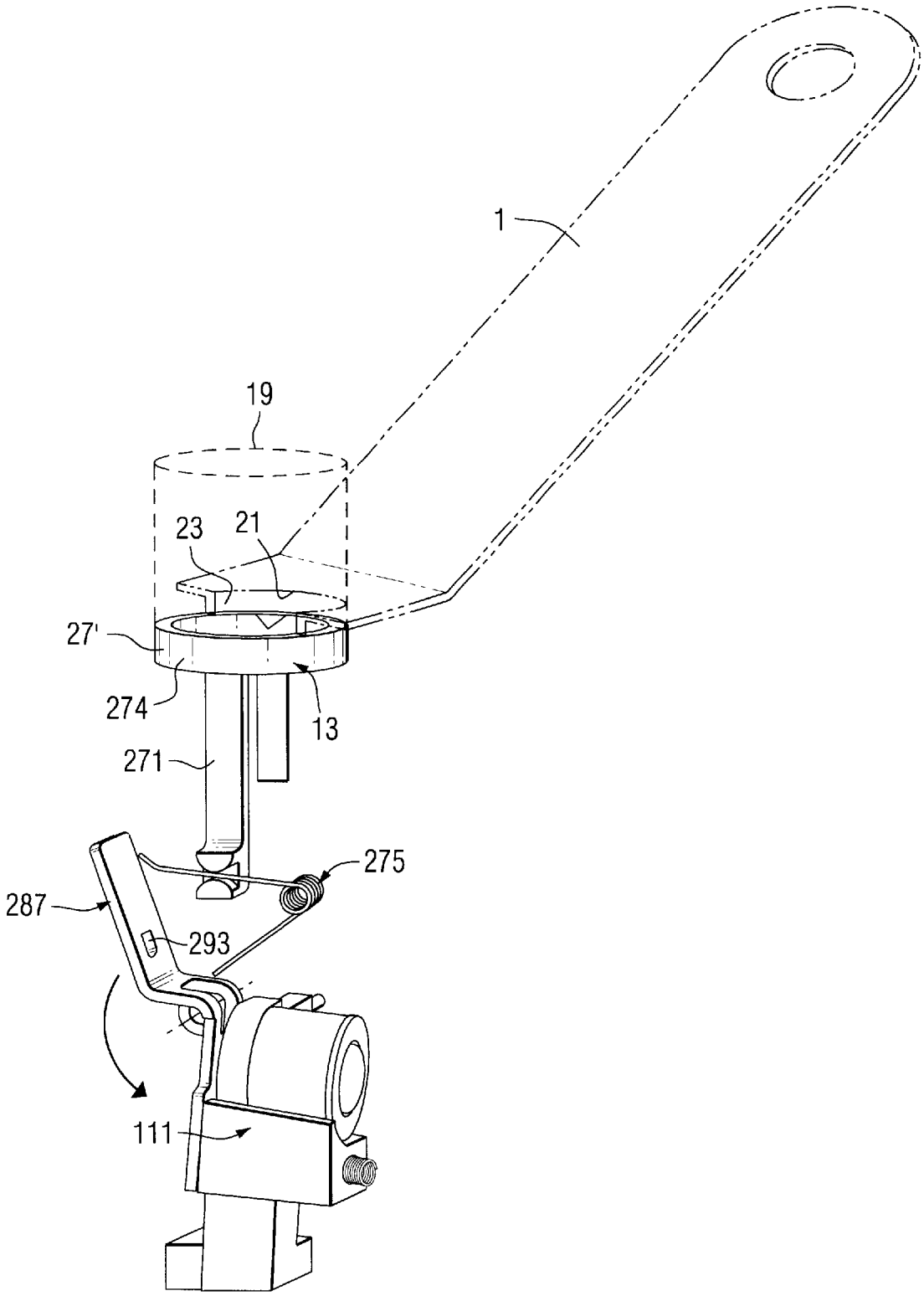
FIG. 3 is an isometric view of the assembly of an arc fault trip actuator and the movable arc fault indicator of FIG. 2, with the indicator reset tool of FIG. 1A shown in phantom line drawing.

The operating handle 15 has a first circumference 17. The movable arc fault indicator 13 has a second, larger circumference 19 (as shown in FIG. 3). The indicator engagement region 9 of the reset tool 1 (as shown in phantom line drawing) includes the arcuate recess 21 corresponding to the first circumference 17 of the operating handle 15, and the arcuate projection 23 corresponding to the second circumference 19 of the movable arc fault indictor 13.

Figure 5:
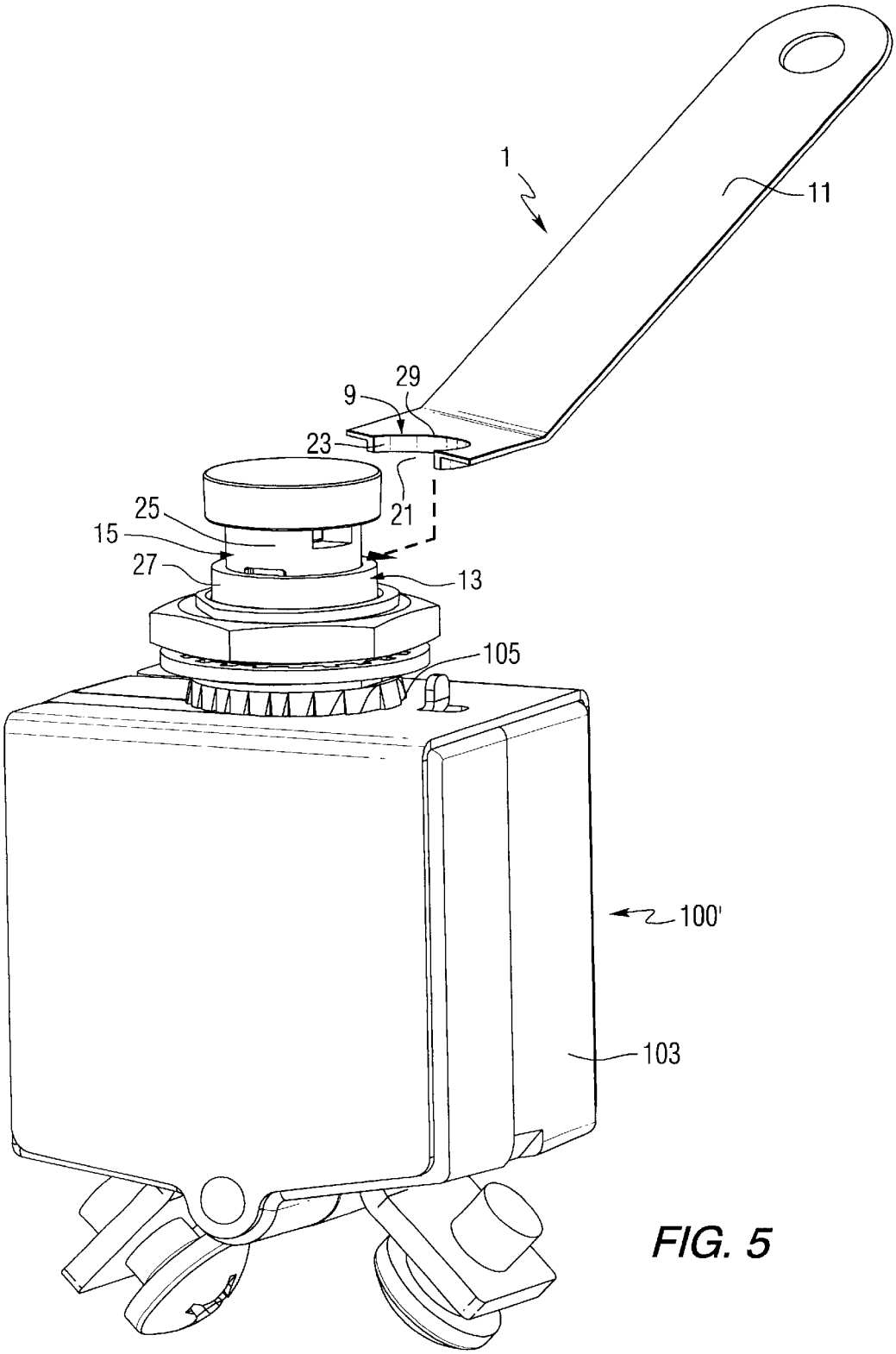
FIG. 5 is an exploded, isometric view of the indicator reset tool of FIG. 1A and the aircraft circuit breaker of FIG. 2.
Figure 6:
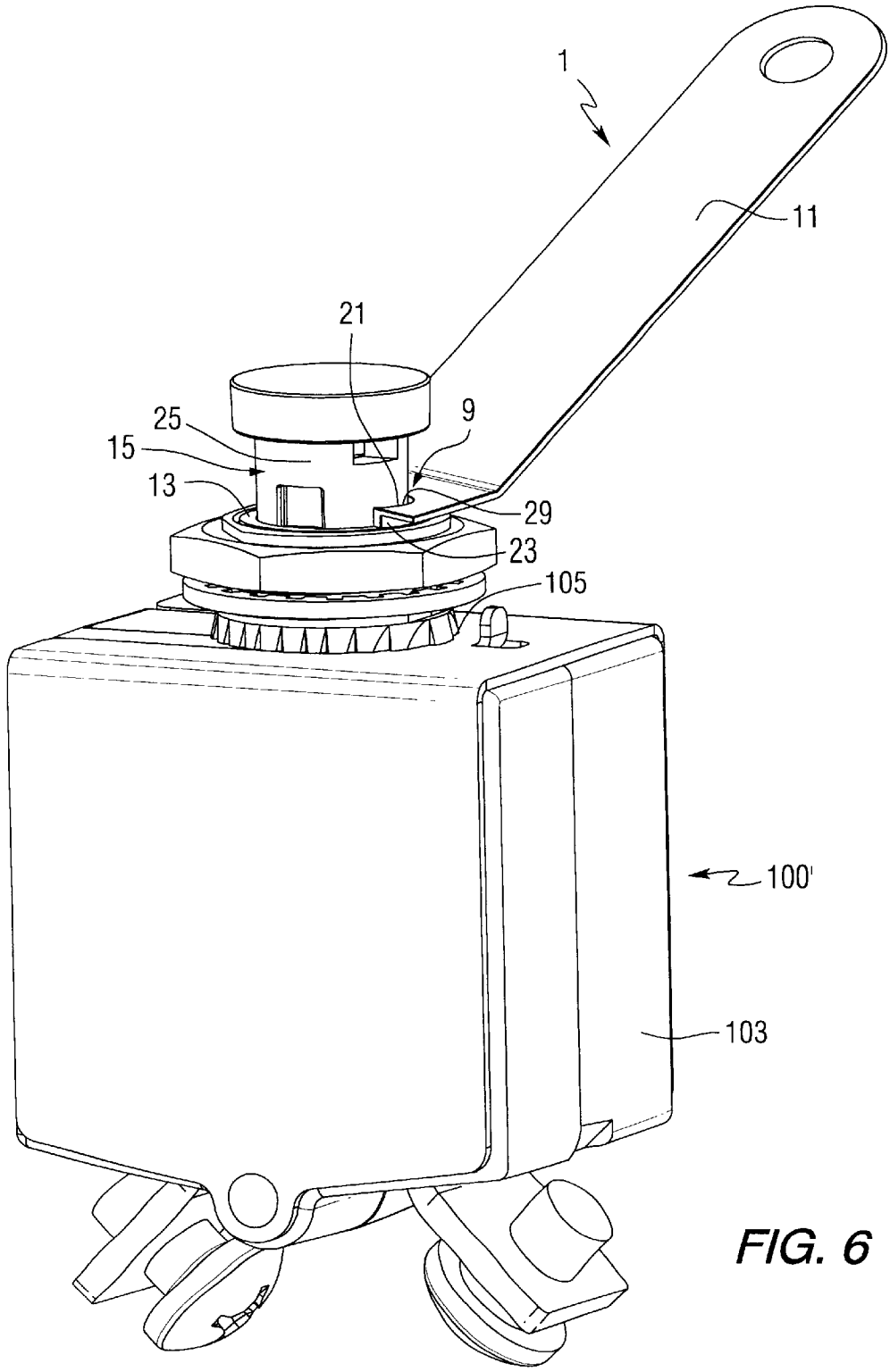
FIG. 6 is an isometric view of the indicator reset tool of FIG. 1A as employed to reset the movable arc fault indicator of the aircraft circuit breaker of FIG. 2.

Referring to FIGS. 5 and 6, a method for engaging and resetting a movable arc fault indicator 13 includes employing a circuit breaker 100' including the housing 103 with the opening 105 through which an operating handle 15 protrudes; providing the movable arc fault indicator 13; providing the reset tool 1 with the handle member 11 and the indicator engagement region 9 structured to engage the movable arc fault indicator 13; holding (e.g., grasping by a user) the handle member 11 of the reset tool 1; engaging the movable arc fault indicator 13 with the indicator engagement region 9 of the reset tool 1; and pressing downward on the handle member 11 in order that the indicator engagement region 9 depresses and resets the movable arc fault indicator 13. The circuit breaker 100' may be similar to, or different from, the circuit breaker 100 of FIG. 2.

The disclosed method of resetting the movable arc fault indicator 13, preferably, further comprises engaging the movable arc fault indicator 13 at about the second circumference 19 thereof, with the arcuate projection 23 of the indicator reset tool 1, and, engaging the operating handle 15 at about the first circumference 17 thereof, with the arcuate recess 21 of the reset tool 1.

In the exemplary embodiment of FIGS. 5 and 6, the circuit breaker operating handle 15 and the movable arc fault indicator 13 include respective circular portions 25 and 27. The arcuate recess 21 of the indicator engagement region 9 of the reset tool 1 has an edge 29. The arcuate projection 23 of the indicator engagement region 9 is disposed proximate the edge 29 of the arcuate recess 21.

Figure 7:
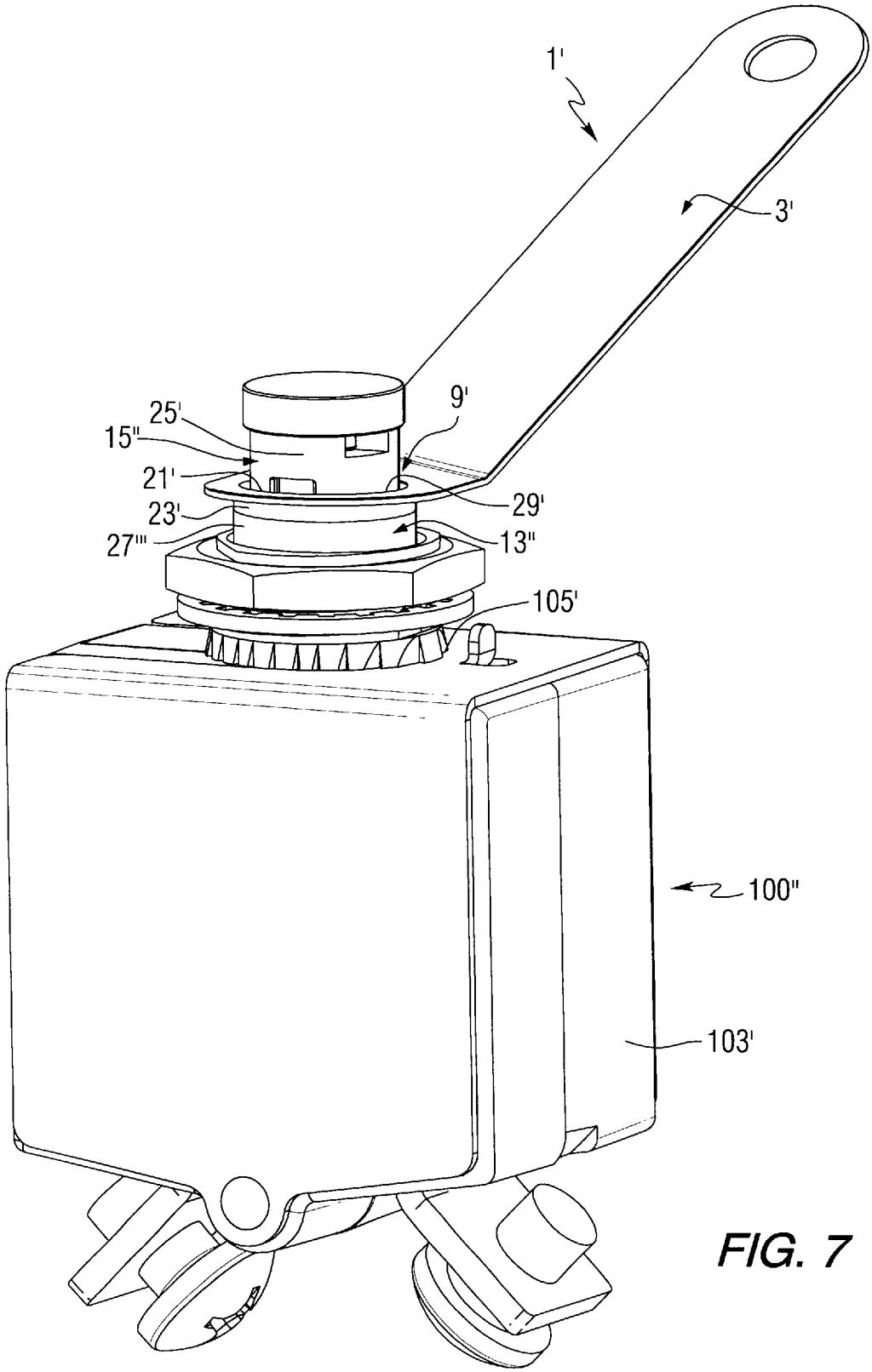
FIG. 7 is an isometric view of an indicator reset tool as employed to reset a movable arc fault indicator of an aircraft circuit breaker in accordance with another embodiment of the invention.

It will be appreciated that while the exemplary indicator reset tool 1 employs the arcuate recess 21 (FIG. 1C) and the arcuate projection 23 (shown in phantom line drawing in FIG. 1C), the recess 21 and the projection 23 may be a variety of shapes, including, for example, a circular recess 21' or opening (as shown engaging circular portion 25' of operating handle 15" in FIG. 7) and circular projection 23' (as shown engaging circular portion or ring 27'" of movable arc fault indicator 13" in FIG. 7).

FIG. 3 illustrates the basic components of an arc fault indicator assembly, as disclosed in U.S. patent application Ser. No. 09/845,517, filed Apr. 30, 2001, now U.S. Pat. No. 6,522,228, which is hereby incorporated by reference. This assembly includes an indicator leg 271 engaged by a spring 275 and mechanically held down by an indicator latch 287. When an arc fault trip occurs, the indicator latch 287 is actuated, resulting in a counterclockwise rotation (with respect to FIG. 3) of the latch 287 to the actuated position shown in FIG. 3. When the indicator latch 287 is so moved, the spring 275 is released from the indicator latch opening 293, which allows the spring 275 to push up the indicator leg 271 internal to the housing 103 of FIG. 2, thereby moving the indicator ring 274 away from and external to the housing 103, as shown in FIGS. 2 and 5, in order to indicate an arc fault trip condition.

In the exemplary embodiment, the arcuate projection 23 of the reset tool 1 engages at least a portion of the circular portion 27 of the movable arc fault indicator 13 (FIG. 2), which is a ring 27' (as shown in FIG. 3). In the arc fault indicator assembly of FIG. 3, the arc fault trip actuator 111, when energized, actuates the movable arc fault indicator 13 by moving it upward to protrude out of the opening 105 in the circuit breaker housing 103 (FIG. 2), in order to indicate that an arc fault has occurred (as shown with movable arc fault indicator 13 of FIGS. 2 and 5).

Figure 4:
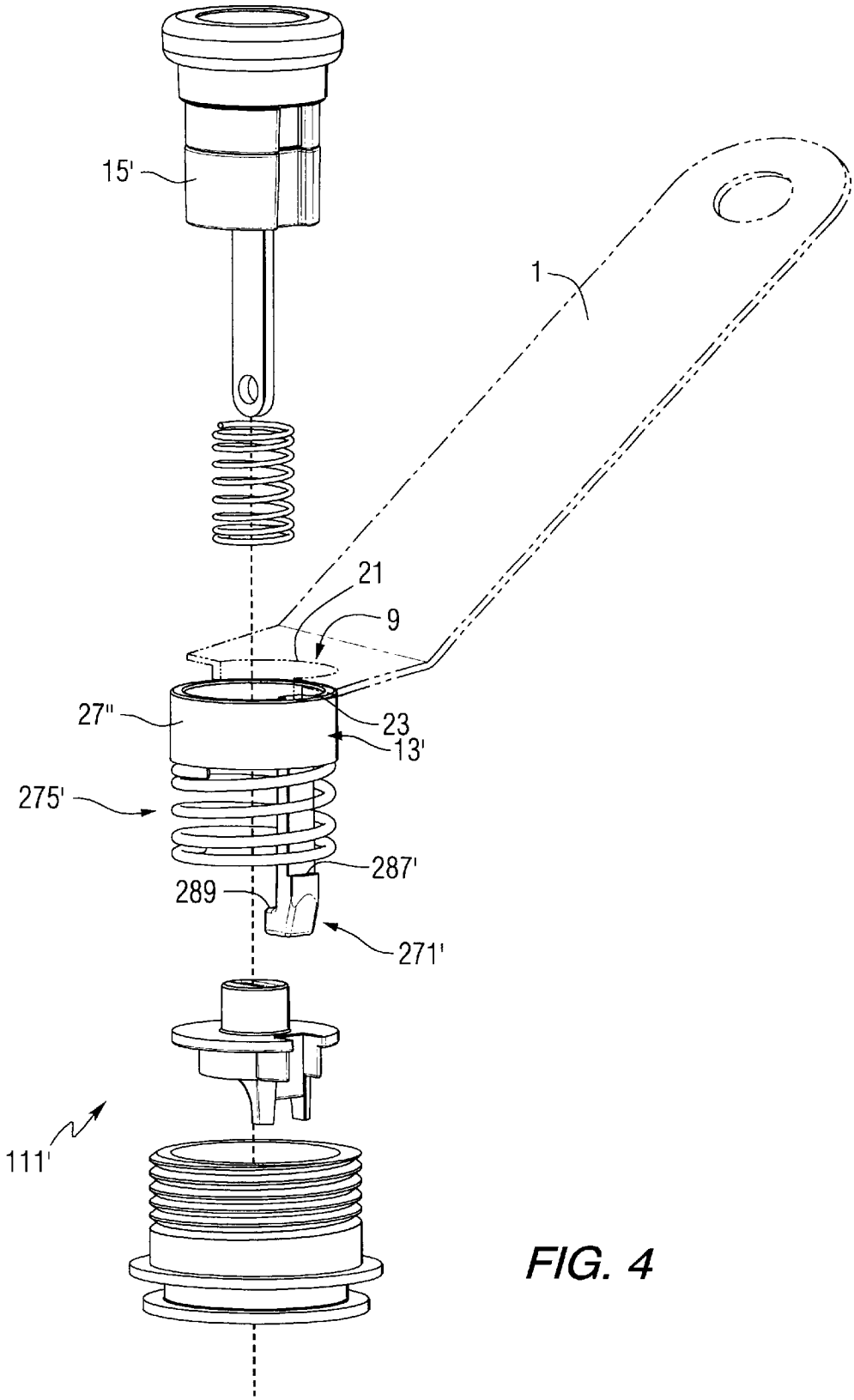
FIG. 4 is an exploded, isometric view of the assembly of a movable arc fault indicator and arc fault trip actuator, in accordance with another embodiment of the invention, with the indicator reset tool of FIG. 1A shown in phantom line drawing.

It will be appreciated that the movable arc fault indicator 13 may be various lengths, sizes, and shapes. For example, FIG. 4 shows a movable arc fault indicator 13' and arc fault trip actuator 111' assembly, in which the movable arc fault indicator 13' includes a ring 27" that surrounds the operating handle 15'. The ring 27" includes an indicator leg 271' having an indicator latch 287' and a shoulder 289. Following detection of an arc fault, the indicator latch 287' releases a helical compression spring 275' to push the indicator ring 27" upward, away from and external to a circuit breaker housing (not shown). The shoulder 289 limits upward travel of the ring 27" (e.g., by preventing the ring 27" from sliding off of the operating handle 15'). From the alternative embodiment of FIG. 4, one will appreciate that movable arc fault indicators 13,13' may be actuated by a wide array of methods using a variety of actuator assemblies. The indicator reset tool 1, in accordance with the present invention, may be employed to engage and reset all such indicators.

FIG. 5 shows the exemplary indicator reset tool 1 as employed immediately prior to engaging and resetting the movable arc fault indicator 13 in the raised, tripped position. FIG. 6 shows the exemplary indicator reset tool 1 as employed after depressing and resetting the movable arc fault indicator 13. Both the operating handle 15 and the movable arc fault indicator 13 of FIG. 6 are in their normal positions, indicating the normal operating condition of the circuit breaker 100.

FIG. 7 shows an indicator reset tool 1' having an opening 21'. The operating handle 15" of circuit breaker 100" passes through that opening 21'. The indicator reset tool 1' is employed with the operating handle 15" and with movable arc fault indicator 13" disposed away from the housing 103' in the raised, arc fault trip position. The operating handle 15" may be in the ON position or the OFF (or tripped) position. Although the circuit breaker 100" employs a two-position operating handle, the invention is applicable to circuit breakers employing operating handles with two or more positions (e.g., ON, OFF and tripped positions). The movable arc fault indicator 13" protrudes through the opening 105' in the housing 103'. The circular portion of the movable arc fault indicator 13" is a ring 27'", which surrounds the circular portion 25' of the operating handle 15". The circuit breaker 100" is similar to the circuit breaker 100 of FIG. 2, except that the diameter of the operating handle 15" is relatively smaller to accommodate the opening 21'.

Reset operation using the indicator reset tool 1' of FIG. 7 includes, providing a circular projection 23' around the edge 29' of the opening 21'; positioning the opening 21' around the operating handle 15" in order that the opening 21' surrounds the circular portion 25' of the operating handle 15"; engaging the indicator ring 27'" of the movable arc fault indicator 13" with the circular projection 23'; and pressing downward on the reset member 3' in order that the indicator engagement region 9' of the indicator reset tool 1' depresses and resets the movable arc fault indicator 13".

The aircraft circuit breakers 100,100',100" are commonly known in the art as subminiature circuit breakers. Such circuit breakers are typically small in size (e.g., approximately 1" by 1" by 1" in the exemplary embodiment) to accommodate the limited space and weight requirements associated with aircraft. The exemplary indicator reset tools 1,1' may be advantageously employed to quickly and easily reset the corresponding movable arc fault indicators 13,13', 13".

The exemplary operating handle 15 of FIG. 2 may operate independently from the movable arc fault indicator 13. In this manner, following any trip, the operating handle 15 may be reset to the ON position of FIG. 6, without moving the movable arc fault indicator 13 from the arc fault trip indicating position of FIG. 5. For example, during aircraft operation, it may be highly advantageous during operation of a critical or important power system to re-energize such system through the operating handle 15, while leaving the movable arc fault indicator 13 in its arc fault trip indicating position. In this manner, the aircraft may be safely operated (e.g., the risk of not energizing that power system outweighs the risk of an arc fault), while leaving the movable arc fault indicator 13 deployed for subsequent attention by maintenance personnel only after the aircraft has safely landed. Upon noticing the raised position of the movable arc fault indicator 13 (as shown in FIG. 5), maintenance personnel are alerted that an arc fault had occurred on the associated power circuit. Similarly, the movable arc fault indicator 13 may be reset from the arc fault trip indicating position of FIG. 5, without moving the operating handle 15 between the OFF and ON positions thereof, by engaging the movable arc fault indicator 13 with the indicator engaging portion 9 of the indicator reset tool 1 (as best shown in FIG. 6) and pressing downward on the handle portion 11 of the indicator reset tool 1 to depress and reset the movable arc fault indicator 13.

Whether by a pilot or crewmember in flight or, more commonly, by maintenance personnel in connection with repairs, the indicator reset tools 1,1' in accordance with the present invention permit an arc fault indicator 13,13',13" to be quickly, easily, and economically reset.

The indicator reset tools 1,1' may be made from a wide variety of materials (e.g., without limitation, plastic or metal). The indicator reset tools 1,1' may also be made by a wide array of manufacturing processes (e.g., without limitation, forming, molding, casting, or stamping). The exemplary indicator reset tools are one-piece reset members. However, such tools may be constructed from more than one segment and from more than one type of material, with each separate segment being coupled together to form a one-piece reset tool assembly (not shown).

The exemplary reset member 3 employs the arcuate recess 21 (as best shown in FIG. 1C) and the arcuate projection 23 (as best shown in FIG. 2). However, a wide variety of differently shaped recesses and projections may be employed. Any suitable recess shape corresponding to an operating handle shape may be employed. For example, without limitation, the circular recess 21' or aperture in the indicator engaging portion 9' of the reset member 3', may be employed to engage at least a portion of the operating handle 15" and the circular projection 23' may be employed to engage at least a portion of the movable arc fault indicator 13" of FIG. 7.

The one-piece, simplistic and readily employable indicator reset tools 1,1' quickly, easily, and economically reset a movable arc fault indicator either in flight or, more commonly, in connection with maintenance repairs on the ground.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An indicator reset tool for use with an electrical switching apparatus, said electrical switching apparatus including a housing having an opening, separable contacts mounted within said housing, an operating mechanism for opening and closing said separable contacts, an operating handle protruding from said opening of said housing, a movable indicator, and an actuator for actuating said movable indicator and actuating said operating mechanism to trip said separable contacts open, said indicator reset tool comprising:

a reset member including a first end and a second end, the first end of said reset member having an indicator engaging portion structured to depress and reset said movable indicator when actuated, the second end of said reset member having a handle portion structured for gripping by a user.

2. The indicator reset tool of claim 1 wherein said operating handle includes a first circumference; wherein said movable indicator includes a second circumference; and wherein said indicator engaging portion includes a recess and a projection, said recess corresponding to the first circumference of said operating handle and being structured to surround at least a portion of said operating handle, said projection corresponding to the second circumference of said movable indicator and being structured to engage at least a portion of said movable indicator in order to depress and reset said movable indicator.

3. The indicator reset tool of claim 2 wherein said operating handle has a circular portion; wherein said recess of said indicator engaging portion is an arcuate recess structured to surround at least a portion of the circular portion of said operating handle, said arcuate recess having an edge; wherein said movable indicator has a circular portion; and wherein said projection is an arcuate projection disposed at the edge of said arcuate recess and structured to engage at least a portion of the circular portion of said movable indicator.

4. The indicator reset tool of claim 3 wherein the circular portion of said movable indicator is a ring surrounding the circular portion of said operating handle.

5. The indicator reset tool of claim 1 wherein said reset member includes at least one bend between first and second ends thereof, in order that said indicator engaging portion is offset from said handle portion.

6. The indicator reset tool of claim 1 wherein said handle portion of said reset member includes an aperture proximate the second end of said reset member.

7. The indicator reset tool of claim 1 wherein said electrical switching apparatus is a circuit breaker; and wherein said movable indicator is an arc fault indicator.

8. The indicator reset tool of claim 7 wherein said circuit breaker is an aircraft circuit breaker; and wherein said arc fault indicator is capable of being reset during flight operations.

9. A circuit breaker comprising:

a housing with an opening;

an operating handle protruding from said opening;

separable contacts mounted within said housing;

an operating mechanism for opening and closing said separable contacts;

an overcurrent assembly responsive to selected conditions of current flowing through said separable contacts for actuating said operating mechanism to trip said separable contacts open;

a movable arc fault indicator;

an arc fault trip actuator which when energized actuates said movable arc fault indicator and actuates said operating mechanism to trip said separable contacts open;

an arc fault current assembly responsive to selected arc fault conditions of current flowing through said separable contacts for energizing said arc fault trip actuator to actuate said movable arc fault indicator and to actuate said operating mechanism to trip said separable contacts open; and a reset tool comprising:

an elongated handle member, and an indicator engagement portion disposed opposite said elongated handle member, said indicator engagement portion structured to engage and reset said movable arc fault indicator.

10. The circuit breaker of claim 9 wherein said operating handle includes a first circumference; wherein said movable arc fault indicator includes a second circumference; and wherein said indicator engagement portion includes a recess and a projection, said recess corresponding to the first circumference of said operating handle and being structured to surround at least a portion of said operating handle, said projection corresponding to the second circumference of said movable arc fault indicator and being structured to engage at least a portion of said movable arc fault indicator in order to depress and reset said movable arc fault indicator.

11. The circuit breaker of claim 10 wherein said operating handle has a circular portion; wherein said recess of said indicator engagement portion is an arcuate recess structured to surround at least a portion of the circular portion of said operating handle, said arcuate recess having an edge; wherein said movable arc fault indicator has a circular portion; and wherein said projection is an arcuate projection disposed at the edge of said arcuate recess and structured to engage at least a portion of the circular portion of said movable arc fault indicator.

12. The circuit breaker of claim 11 wherein the circular portion of said movable arc fault indicator is a ring surrounding the circular portion of said operating handle.

13. The circuit breaker of claim 9 wherein said reset tool includes at least one bend between said elongated handle member and said indicator engagement portion, in order that said indicator engagement portion is offset from said elongated handle member.

14. The circuit breaker of claim 9 wherein said elongated handle member includes an end opposite said indicator engagement portion, with an aperture proximate said end.

15. The circuit breaker of claim 9 wherein said circuit breaker is an aircraft circuit breaker; and wherein said movable arc fault indicator is capable of being reset during flight operations.

16. A method for resetting an arc fault indicator of a circuit breaker, said method comprising:

employing a circuit breaker including a housing with an opening through which an operating handle protrudes;

providing a movable arc fault indicator;

providing a reset tool with a handle member and an indicator engagement region structured to engage said movable arc fault indicator;

holding said handle member of said reset tool;

engaging said movable arc fault indicator with said indicator engagement region of said reset tool; and pressing downward on said handle member in order that said indicator engagement region depresses and resets said movable arc fault indicator.

17. The method of claim 16 further comprising:

providing a first circumference on said operating handle;

providing a recess in said indicator engagement region of said reset tool, with said recess corresponding to the first circumference of said operating handle;

providing a second circumference on said movable arc fault indicator;

providing a projection on said indictor engagement region, with said projection corresponding to the second circumference of said movable arc fault indicator; and engaging at least a portion of said movable arc fault indicator with said projection of said indicator engagement portion.

18. The method of claim 17 further comprising:

providing a circular portion on said operating handle;

providing as said recess an arcuate recess having an edge;

providing a circular portion on said movable arc fault indicator;

disposing said projection proximate the edge of said arcuate recess; and engaging at least a portion of said circular portion of said movable arc fault indicator with said projection.

19. The method of claim 18 further comprising:

employing an arcuate projection as said projection; and engaging at least a portion of the circular portion of said movable arc fault indicator with said arcuate projection of said indicator engagement region.

20. The method of claim 19 further comprising:

engaging at least a portion of the circular portion of said operating handle with said arcuate recess of said reset tool.

21. The method of claim 17 further comprising:

engaging said movable arc fault indicator at about the second circumference thereof with said projection of said indictor engagement region.

22. The method of claim 17 further comprising:

providing as said recess an opening having an edge;

providing as said projection a circular projection disposed at the edge of said opening;

positioning said opening around said operating handle in order that said opening surrounds said operating handle at about the first circumference thereof; and engaging the movable arc fault indicator at about the second circumference thereof with said circular projection.

* * * * *